United States Patent [19]

Hobrough

[11] Patent Number: 4,622,689

[45] Date of Patent: Nov. 11, 1986

[54] STEREOPHONIC SOUND SYSTEM

[76] Inventor: Gilbert L. Hobrough, 699 21st Ave., Vancouver, British Columbia, Canada, V5Z 1Y9

[21] Appl. No.: 697,499

[22] Filed: Feb. 1, 1985

[30] Foreign Application Priority Data

Feb. 1, 1984 [GB] United Kingdom ..... 8402682

[51] Int. Cl.[4] ..... H04R 5/00

[52] U.S. Cl. ..... 381/24; 381/26; 381/27

[58] Field of Search ..... 381/1, 24, 17, 18, 19, 381/20, 21, 22, 23, 26, 27

[56] References Cited

U.S. PATENT DOCUMENTS

| | | | |
|---|---|---|---|
| 3,665,105 | 5/1972 | Chowning | 381/17 |
| 3,757,046 | 9/1973 | Williams | 381/24 |
| 3,944,735 | 3/1976 | Willcocks | 381/20 |
| 3,982,071 | 9/1976 | Weiss et al. | 381/19 |
| 4,063,034 | 12/1977 | Peters | 381/17 |
| 4,251,685 | 2/1981 | Fellgett | 381/23 |
| 4,352,953 | 10/1982 | Emmer | 381/1 |
| 4,410,761 | 10/1983 | Schickedanz | 381/1 |
| 4,574,391 | 3/1986 | Morishima | 381/24 |

*Primary Examiner*—Forester W. Isen
*Attorney, Agent, or Firm*—William R. Hinds

[57] ABSTRACT

A stereophonic sound system has the conventional components of a stereo pre-amplifier, to receive and amplify left and right audio signals, originating from left and right channel microphones, and feed left and right power amplifiers for left and right loudspeakers and additionally has left and right attack separator circuits (6+18, 8+20) connected to receive input audio signals from the pre-amplifier (70) and acting to separate the attack components from the steady-state components of the input audio signals, the steady-state components being fed to the left and right power amplifiers (42, 44) and the attack components being fed to an attack correlator (30) which compares the arrival times of the attack components from the left and right audio signals and calculates an azimuth angle corresponding to the point of origin (8) of the original sound, an attack distributor (40) is connected to the outputs of the correlator and distributes transient attack signals to one of a series of small power amplifiers (46, 48, 50, 52) which amplify the transient attack signal for a respective one of a series of high frequency speakers (58, 60 62, 64) arranged between the main left and right speakers (54, 56); by this means the attack portions of the original audio signals can be perceived by a listener as originating from points spread out between the main speakers, which points individually have a relation to the azimuth angle of individual sounds relative to the microphones.

8 Claims, 8 Drawing Figures

STEREOPHONIC SOUND SYSTEM

This invention relates to a stereophonic sound reproduction system and particularly relates to a system that provides an improved reproduction of the azimuth position of high frequency percussive or transient sounds.

It is generally agreed that binaural directional information is perceived through unconscious processes involving three differences between the sound characteristics in the left and right ears of a listener. The first difference is the sound intensity, the second is the phase of a steady-state sound and the third is the difference in arrival times of transient sounds especially the "attack" or leading edge portion thereof.

Below about 150 Hertz (Hz) little or no direction is derived from any of the above processes although the ear is sensitive to sound down to about 25 Hz.

From 150 Hz up to about 800 Hz the direction of a steady-state sound can be estimated to some extent by phase difference. Above about 600 Hz the direction of a steady-state sound is derived from the difference in sound pressure or intensity in the ears. The sensitivity of azimuth estimation for a steady-state sound increases with frequency up to about 3 KHz as a rule. Above 3 KHz multiple path effects lead to ambiguity and confusion. The precision of estimating the azimuth of a steady-state sound source is about ±45 Degrees for casual listening reaching perhaps ±20 Degrees with careful listening out-of-doors.

Above about 1.5 KHz transient sounds can be located in azimuth to a higher degree of precision than steady-state sounds. Above 3 KHz transient sounds with a sharp attack can be located within about 5 Degrees. The chirp of a cricket under a leaf (6–15 KHz) can be located within 2 or 3 Degrees if the occasion demands.

During the last few years the ability of loudspeakers for conventional stereophonic sound reproduction systems to reproduce accurately transient sounds has improved remarkably. This is true not only for ribbon speakers, which are one of the more spectacular examples, but also of almost every "HI-FI" speaker on the market.

It is anomalous that the least definitive direction factors are used as the basis of spatial separation in conventional stereophonic sound reproduction systems.

In fact the increased transit precision of the new loudspeakers introduces a problem. The ear is very adept at localizing transient sounds such as those associated with percussion or plucked strings, thus being rather more natural for the listener to identify the transient content of two channel stereophonically reproduced music to be coming from the two separate sound sources rather than a point between them.

Thus, precise transient reproduction tends to have a bad effect on the imaging of a stereophonic sound system. For many types of music, a distinct "hole-in-the-middle" of the image is developed.

It is an object of the present invention to eliminate this hole-in-the-middle resulting from the ear's identification of two widely separated sound sources.

It is a further object of the present invention to reproduce high frequency transient sounds in a form that enables a listener to derive a close approximation to the azimuth position of various sources.

According to the present invention, apparatus for a stereophonic sound system comprises:

(i) a left channel and a right channel microphone each arranged to receive input sounds and produce left and right signals respectively, the microphones being laterally separated;

(ii) for each channel, means connected to the microphone to separate the attack from the high frequency portion of each respective audio signal and produce an attack signal and a remainder or attackless signal;

(iii) comparator means connected to the left and right separator means, having a series of at least three output channels and arranged to receive and compare left and right attack signals to determine their arrival time difference and to allocate resultant attack signals to particular output channels;

(iv) multiplier means connected to the left and right separator means and to the comparator means, having a series of outputs corresponding to the comparator output channels and arranged to receive left and right attackless signals, multiply the attackless signals with the attack allocation signals and produce a combined attack audio signal at a corresponding output;

(v) a lateral array of high frequency sound radiators each connected to a related channel of the multiplier means;

the allocation of a resultant attack signal to a particular channel by the comparator means and eventually to the reproduction of an attack audio signal by a particular radiator in the array being in accordance with the arrival time difference between the left attack signal and the right attack signal from a given input sound whereby the position of the particular radiator corresponds angularly to the azimuth position of the source of the input sound relative to the microphones.

In an embodiment of the present invention, the apparatus further comprises:

(i) means connected to the microphones to transmit and/or record the left and right audio signals;

(ii) means to receive or replay the left and right audio signals;

(iii) for the left and right channels, a high frequency pass filter connected to the receiver or the replay means;

(iv) an envelope detector connected to each filter to detect an envelope for each audio signal waveform and derive an envelope signal and a waveshape signal, the output of each envelope detector being connected to the input of an attack separator; and, (v) additional multiplier means each connected to the output of one of the envelope detectors and to the output of one of the separator means to multiply the waveshape signal with the attackless signal and produce a combined steady-state signal for each channel.

With suitable amplifiers and loudspeakers for the left and the right combined steady-state signals and amplification for the attack signals, a stereophonic reproduction system is obtained which reproduces input sounds in a form that enables a listener to perceive the apparent azimuth position of a high frequency transient; i.e. the apparatus produces a better stereophonic audio image of input sounds.

Envelope detection is a method of deriving a meaningful lower frequency signal from a high frequency waveform in a manner akin to detecting the modulation of a frequency modulated waveform. Indeed, the envelope detector can be a rectifier followed by a low frequency pass filter and will produce a lower frequency d.c. biassed signal from a higher frequency alternating waveform. The derived "envelope" signal has a correspondence to the shape of the original waveform and, being of a lower frequency, permits some signal treatments not possible at higher frequencies.

Thus stereophonic sound apparatus in accordance with the present invention reproduces high frequency transient sounds in a form that enables the brain to construct an audio image of the original source because the characteristic of the high frequency band sounds that is used to perceive azimuth position is reproduced from the appropriate angular position. The greater the number of attack channels and radiators, the more accurate will be the azimuth position of the high frequency transient image. The left and right steady-state signals from the left and right loudspeakers producing the rest of the stereo sounds in the same manner as conventional stereophonic sound reproduction apparatus.

The above and other features of the present invention are illustrated in the Drawings, wherein.

Figure 1:
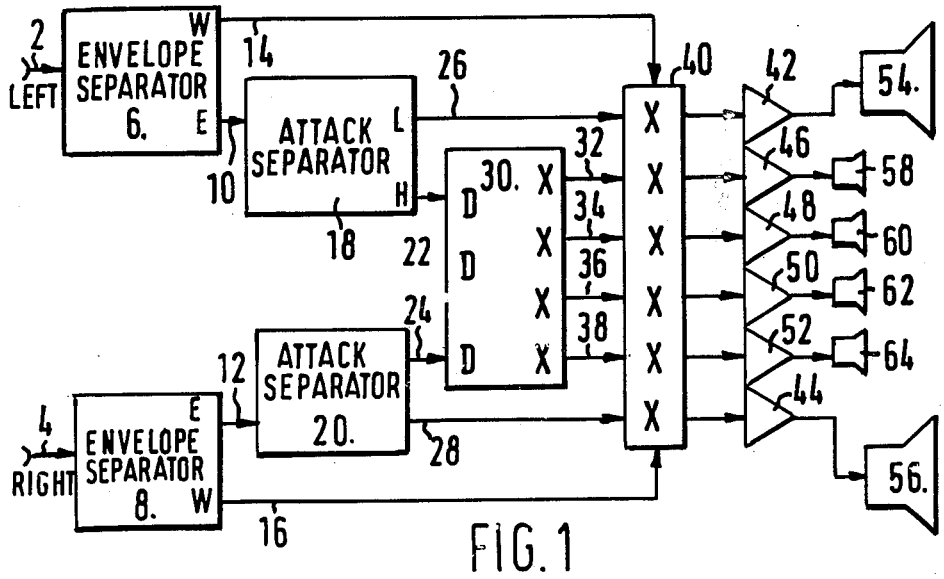
FIG. 1 is a block diagram of a basic circuit for apparatus in accordance with the invention.

The basic circuit for a stereo sound system is shown by FIG. 1 to consist of a pair of input ports 2 and 4 for the left channel and the right channel respectively; these ports inputting left and right audio waveform signals from a recorder or the like (not shown). Each port is connected to an envelope separator 6 or 8, which each produce a signal (the envelope signal) from one output port 10 or 12 (which signal is representative of the modulation of the input audio waveform) and a waveshape signal (which signal is representative of the instantaneous level of the input audio waveform) from another output 14 or 16.

An attack separator 18 or 20 is connected to the envelope signal output 10 or 12 of a respective envelope separator 6 or 8 and produces a signal (the attack signal) from an output port 22 or 24 and an envelope remainder signal (the envelope signal minus the attack signal, hereinafter the "attackless" signal) from another output 26 or 28.

A comparator 30 is connected to the attack signal outputs 22 and 24 to receive pulses therefrom and has a series of output channels 32, 34, 36 and 38 in this example. The comparator acts to compare arrival time differences between incoming left and right attack pulses and, as the result of the time difference, produces an attack pulse at a particular one of the output channels 32 to 38.

A series of recombination multipliers 40 is connected to the envelope separators 6 and 8, the attack separators 18 and 20 and to the comparator 30 to receive the left and right waveshape signals, the left and right attackless signals and the left and right attack signal pulses; the series of multipliers act to multiply the following signals:

left channel waveshape X left channel attackless=left channel non-attack audio;

left channel waveshape X left side* attack pulses=left side attack audio;

right channel waveshape X right side* attack pulses=-right side attack audio; and, right channel waveshape X right channel attackless=-right channel non-attack.

(* side herein means to one side or the other of a median line between the comparator outputs.)

Each multiplier output is connected to an audio amplifier; a power amplifier 42 or 44 for the left and right non-attack signals and peak power amplifiers 46, 48, 50 and 52 for the attack signals. Finally, suitable full audio frequency range loudspeakers or speaker combinations 54 or 56 are connected to the left and right power amplifiers and an array of high frequency sound radiators 58, 60, 62 and 64 are connected to the peak amplifiers.

Figure 2:
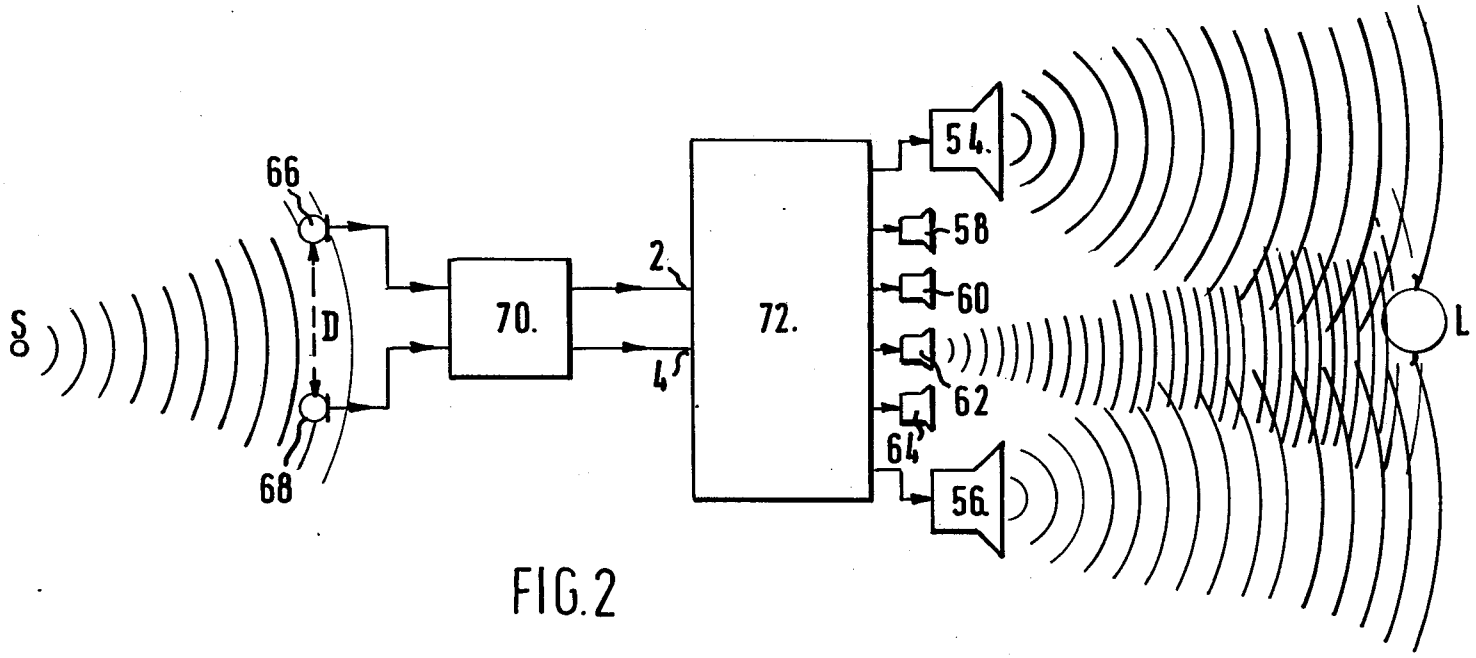
FIG. 2 is a diagram illustrating the operation of the apparatus of FIG. 1.

Operation of apparatus in accordance with the invention is illustrated by FIG. 2 which shows, in a schematic plan, a left microphone 66 and a right microphone 68 laterally separated by a suitable distance D (thought to be about twice the separation of a listener's ears) and arranged to receive sound waves from a source S and to produce left and right audio waveform signals that are fed to receive/replay means 70 (such as a phonograph, tape recorder, digital disc). Received or replayed signals are passed to input ports 2 and 4 for the apparatus, generally designated 72. Full frequency steady-state sounds are emitted from the loudspeakers 54 and 56, the only parts missing being the attack pulses and these are emitted from one of the attack radiators 58 to 64. Thus, the left and right channel speakers provide an effectively conventional stereo effect to a listener L; the only difference being that transient attacks are absent, although sustained high frequencies are present. To a listener the stereo effect is improved because of the absence of these high frequency attack pulses (which can sound like a "click"), this is because as explained above the arrival time differences of such transients are used to derive azimuth location of a sound source. A conventional stereo system emits transients from both speakers which provides a false audio image to a listener who will be fooled into thinking there to be a source behind each speaker for transient sounds.

The emission of an attack pulse from one of the attack radiators 58 to 64 and synchronously with the rest of the stereo audio from the two speakers 54 and 56 will produce a correct stereo image because the emission of the transient is from a position (in the figure radiator 62) that has at least an approximate relation to the position of the source S relative to the microphones and will be correctly interpreted by the listener.

Figure 3:
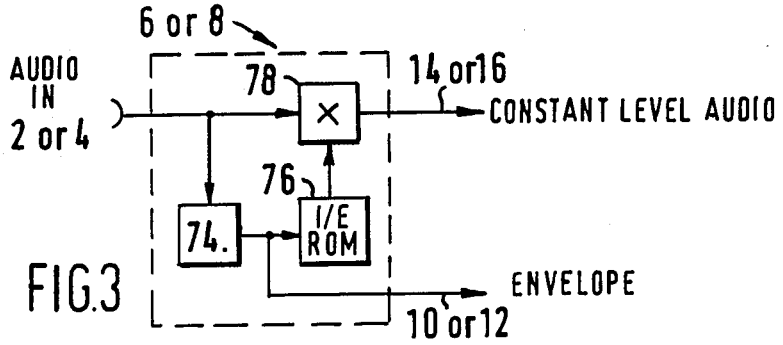
FIG. 3 is a block diagram of a digital embodiment of the invention.

In a digital form of the invention, an envelope separator 6 or 8 is shown by FIG. 3 to consist of an envelope sensor 74 connected to the input port 2 or 4, the output of the sensor forming the output 10 or 12 for the envelope signal from the separator. The output of the sensor is also connected to a ROM 76 itself connected to one input of a multiplier 78; the input port is also connected to a second input to the multiplier. The ROM is arranged to invert the envelope signal and this combines with the multiplier to form a feed forward automatic gain control circuit that maintains a constant level audio signal from output 14 or 16.

Figure 4:
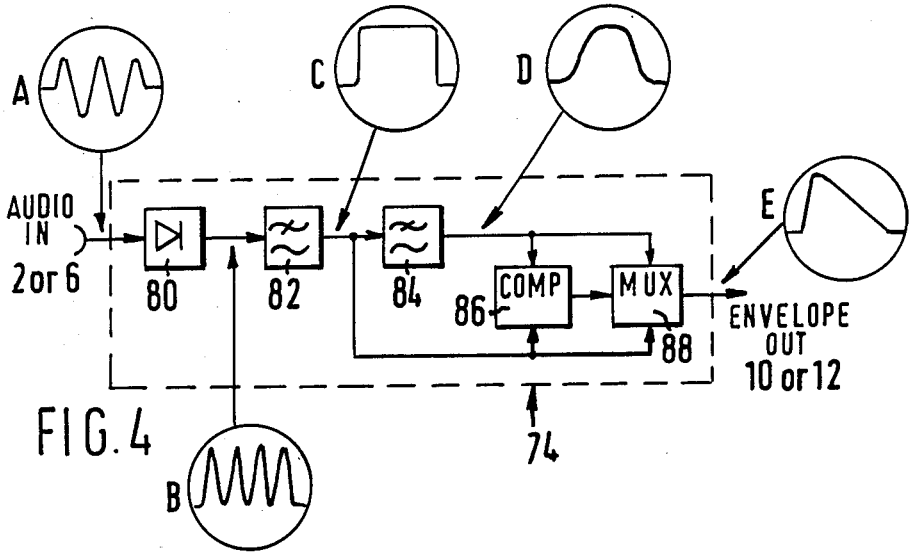
FIG. 4 is a diagram of a digital envelope separator.

A digital envelope sensor 74 is shown by FIG. 4 to consist of a full wave rectifier 80 connected to receive audio input signals and connected to a first F.I.R. low pass filter 82. A second low pass filter 84 is connected to the output of the first filter. A comparator 86 has one input connected to the output of the first filter and a second input connected to the second filter; the comparator output is connected to control a multiplexer 88, the two inputs of which are also connected to the first and second filters respectively. The action of this circuit is illustrated by the waveforms shown for the outputs of the individual components:

an alternating signal A is rectified to form a unidirectional waveform B;

the low frequency components of waveform B are filtered out to leave a square wave C that is the envelope of waveform B;

square wave C is filtered again to form a waveform D with extended rise and fall times; and, comparator 86 switches multiplexer 88 to select output of whichever is the larger of C or D, thereby producing envelope waveform E.

Figure 5:
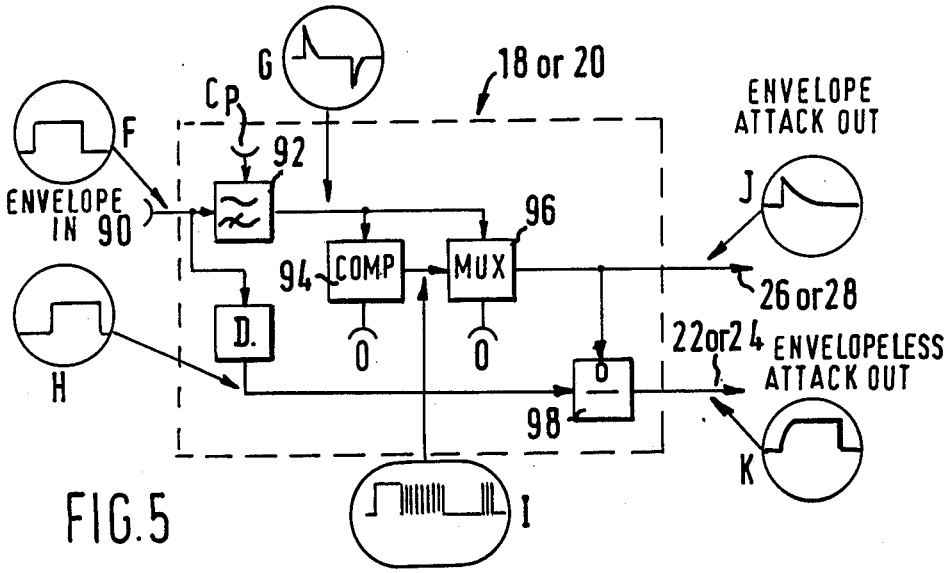
FIG. 5 is a diagram of a digital attack separator.

FIG. 5 shows a digital attack separator 18 or 20 to consist of a port 90 via which envelope signals are input to a high pass F.I.R. type filter 92, that is controlled by clock pulses Cp. The output of this filter is connected both to one input of a comparator 94 and to one input of a multiplexer 96 and the delayed input to the filter is connected to a subtractor 98.

The other inputs of both the comparator and the multiplexer are fed with a zero level signal. The action of this circuit is as follows:

an input envelope pulse F is filtered to produce the high frequency positive and negative going pulses of waveform G;

at the same time a delayed (by one clock pulse) envelope pulse H is also output by delay D, which compensates for the delay in the filter 92;

the +ve and −ve pulses of waveform G are compared to zero by the comparator, whose output waveform I switches the multiplexer between waveform G and zero to produce an envelope attack waveform J; and, the attack envelope J is subtracted from the delayed envelope H to produce the attackless envelope waveform K.

Figure 6:
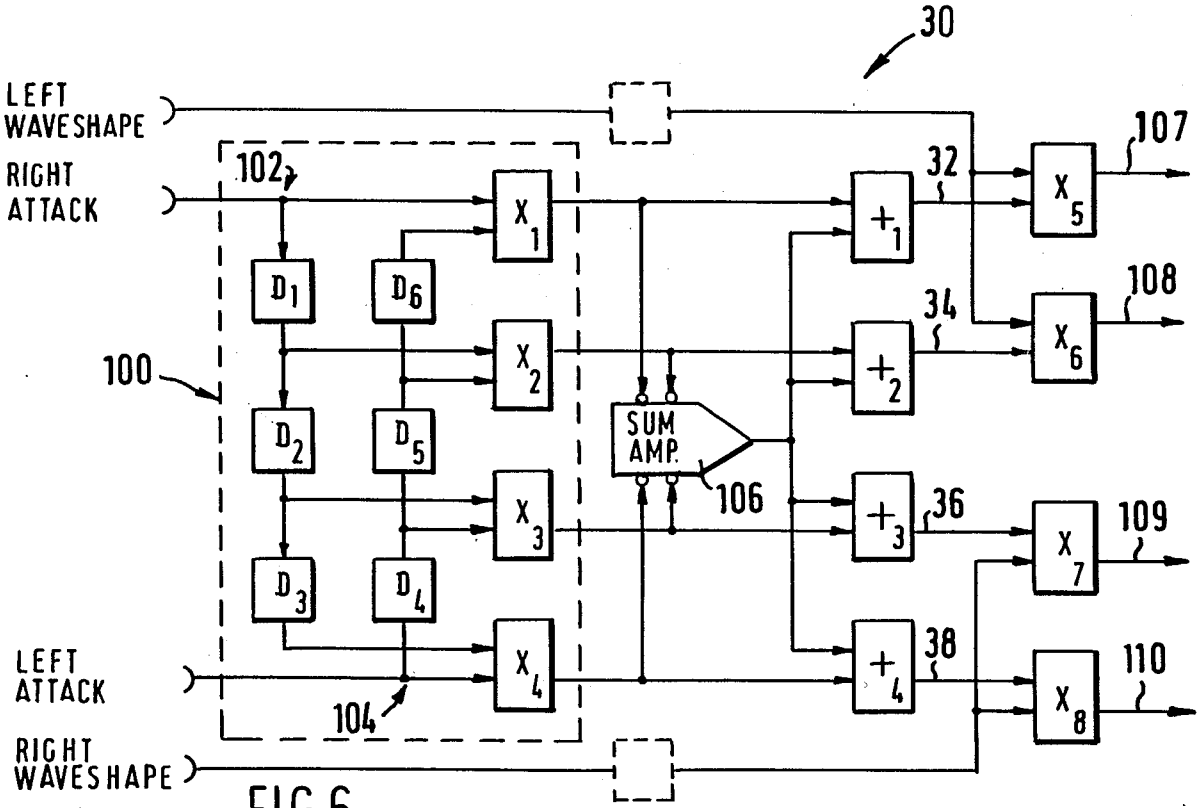
FIG. 6 is a diagram of a correlator.

A suitable comparator is shown by FIG. 6 to consist of a cross correlator 100, formed by two serial delay lines 101 and 102 respectively connected to receive right attack pulses and left attack pulses; corresponding pairs of delays in the delay lines are connected to one-quadrant multipliers as follows:

right attack and delay D6 to multiplier X1;

delays D1 and D5 to multiplier X2;

delays D2 and D4 to multiplier X3; and, left attack and delay D3 to multiplier X4.

The outputs of the multipliers are each respectively connected to one input of a series of adders +1, +2, +3 and +4 and to the inverting inputs of a summing amplifier, the output of which is also connected to the other input of each of the adders.

The outputs 32, 34, 36 and 38 of the adders +1, +2, +3 and +4 are respectively each connected to a two-quadrant multiplier X5, X6, X7 and X8 forming part of the recombination multiplier series 40.

The action of the comparator is as follows:

correlation between incoming pulses is indicated by a high output from one of the multipliers X1 to X4 directly connected to one input of adders +1 to +4 respectively;

the output of amplifier 106 is the inverse of the sum of the outputs of all of multipliers X1 to X4 and this sum is applied to the second input of each of adders +1 to +4;

the output of the adder connected to the multiplier with the high output is therefore enhanced with respect to the outputs from the other adders while keeping the sum of the outputs from the adders, and hence the total output from the attack radiators approximately constant; and, the products of the adder outputs and the left waveshape and the right waveshape signals (left waveshape being input to multipliers X5 and X6 and right waveshape to multipliers X7 and X8) are output on lines 107 to 110 with the maximum signal being output from the multiplier that is linked to the correlation of the input attack pulse and, ultimately to the relative azimuth angle of the sound source as detected by the microphones 66 and 68, clearly the microphone that is closer to the source will receive a transient sound first and the attack pulse for that transient will arrive at the correlator earlier.

If the correlation is such that it "falls" between two delays, then the signals from adjacent multipliers X1 to X4 will both be a maximum and attack pulses will be emitted from adjacent attack radiators. Thus the image of the source should appear to be between the relevant radiators. This correlator circuit is equally suitable for digital and analog systems.

Figure 7:
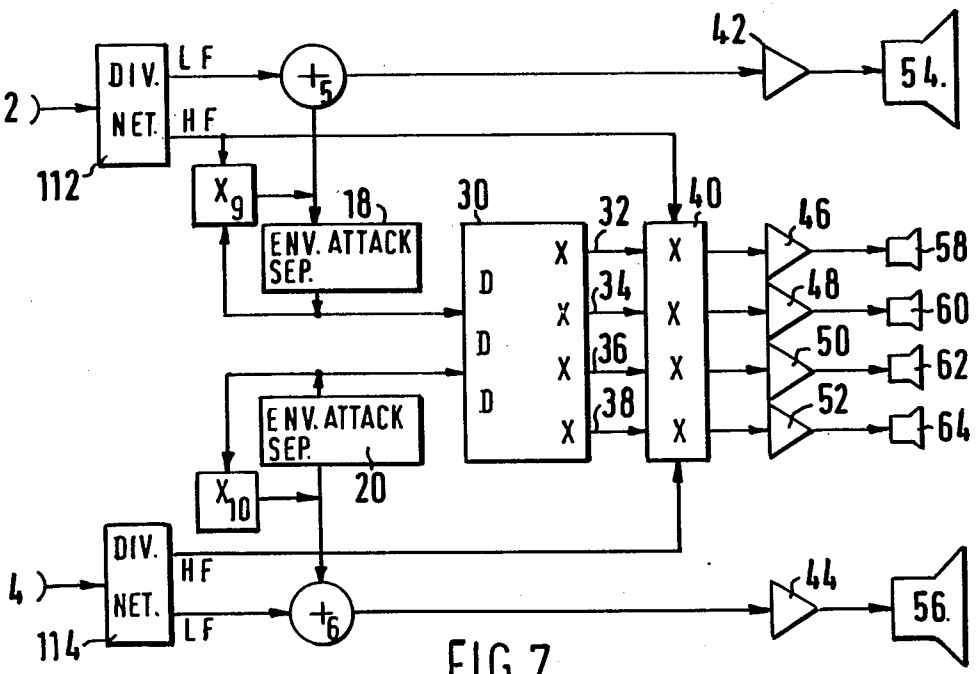
FIG. 7 is a block diagram of an analog embodiment of the invention.

In the analog circuit shown by FIG. 7 like parts have been given like references, the system comprises left and right input ports 2 and 4 each connected to a divider network 112 or 114 which divide the input signals into low frequency components, available at output LF, and high frequency components, available at output HF. The HF outputs are connected to one input of a first multiplier X9 or X10, the outputs of which are each connected to an adder +5 or +6 and to the attack envelope separators 18 and 20 respectively. The output of each attack envelope separator (which both separates the envelope from the high frequency waveform signals and separates the attack pulse from the envelope and is described in detail below in relation to FIG. 8) is connected in a feedback loop to the second input to the first multiplier X9 or X10, as well as being connected to the attack envelope comparator 30.

The action of the circuit is as follows:

the feedback loop formed by the attack envelope separator and the multiplier has a short cycle time in comparison to incoming transients from the HF output of the divider network;

attack transients output from the separator are fed back to the multiplier and of a polarity to reduce the signal from the multiplier and thus suppress the attacks of the transients, which are still initially output by the separator to pass to the comparator; and, the output from the adder will be the sum of the low frequency signal components and the "attackless" high frequency components.

Figure 8:
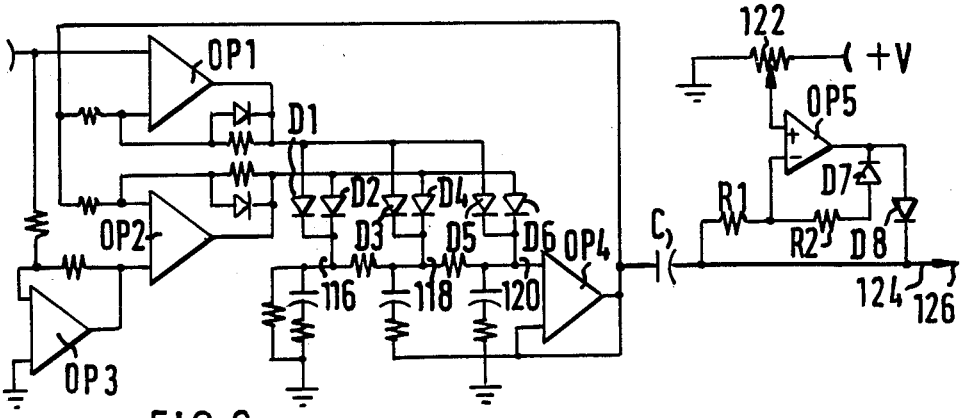
FIG. 8 is a diagram of an analog attack envelope separator.

The attack envelope separator shown by FIG. 8 consists of a pair of operational amplifiers OP1 and OP2 with the incoming high frequency signal components being inverted for amplifier OP2 by another operational amplifier OP3. The fullwave rectifiers are formed by diodes D1 to D6 and connected between the outputs of amplifiers OP1 and OP2. By this means, positive going waveforms are conducted through amplifier OP1 and diodes D1, D3 and D5 to a series of nodal points 116, 118 and 120 respectively in a low-pass Bessel filter, the active element of which is an operational amplifier OP4. Similarly, negative going waveforms are inverted and conducted through amplifier OP2 and diodes D2, D4 and D6 to the nodal points 116, 118 and 120 of the filter. A Bessel filter is employed to prevent overshoot at the output of amplifier OP4. The rectifier and filter together form an envelope detector, the positive pulses output from amplifier OP4 being the envelope or modulation of the input high frequency component signals.

A capacitor C is connected to the output of amplifier OP4 and to the negative input of a fifth and in this instance inverting operational amplifier OP5 via a series resistor R1. The positive input of the amplifier is connected to a gain bias potential divider network 122 which is set to give a negative bias. A diode D7 is serially connected with a resistor R2 in a feedback loop about the amplifier and to resistor R1 while a further diode D8 is connected as shown between the output of the amplifier and a line 124 connecting the capacitor to the output port 126. Positive going transients from the capacitor and input to the negative port of the amplifier will, if the positive port is biassed negatively, send the amplifier output negative, reverse biassing diode D8 to be open and forward biassing diode D7 to be closed and the gain of the loop will be set by the ratio of resistors R2 and R1 (this being to prevent wild open loop excursions in the reverse direction) and the positive going transient or attack envelope will be directly output via line 124. Negative going transients from the capacitor will reverse bias and close diode D7, forward bias and open diode D8 and the output port 126 will be prevented from going positive by current flowing through the amplifier to discharge the capacitor. Thus the amplifier is acting as a precision rectifier. Thus the decay of a high frequency transient will be suppressed or erased, leaving an attack envelope at the output port.

I claim:

1. Apparatus for a stereophonic sound system comprising:

(i) a left channel input and a right channel input, respectively arranged to receive left and right audio signals produced by laterally separated left and right microphones;

(ii) for each channel, separator means connected to the input to separate the attack from the steady state portion of each respective audio signal and produce an attack signal and a remainder or attackless signal;

(iii) comparator means connected to said left and right separator means, having a series of at least three output channels and arranged to receive and compare left and right attack signals to determine their arrival time difference and to generate and allocate resultant attack signals to particular output channels;

(iv) multiplier means connected to said left and right separator means and to said comparator means, having a series of outputs corresponding to said comparator output channels and arranged to receive said left and right attackless signals, multiply said attackless signals with said resultant attack signals and produce a combined attack audio signal at a corresponding output; and (v) a lateral array of high frequency sound radiators each connected to a related output channel of said multiplier means, the allocation of a resultant attack signal to a particular channel by the comparator means and eventually to the reproduction of an attack audio signal by a particular radiator in the array being in accordance with the arrival time difference between the left attack signal and the right attack signal from a given input sound whereby the position of the particular radiator corresponds angularly to the azimuth position of the source of the input sound relative to the microphones.

2. Apparatus as claimed in claim 1 and further comprising, for each of said left and right channels, high frequency pass filter means connected to the input, an envelope separator connected to said filter means to detect an envelope for the waveform of said audio input signal and derive an envelope signal and a waveshape signal, the output of said envelope separator being connected to the input of a respective one of said attack separators, and additional multiplier means connected to the output of said envelope separator and to the output of said one attack separator to multiply said waveshape signal by said attackless signal and produce a combined steady state signal for that channel.

3. Apparatus as claimed in claim 2, wherein said comparator means comprise:

(i) staged serial delay means for said left attack signals;

(ii) staged serial delay means for said right attack signals;

(iii) a series of multipliers, the inputs of each one of which are responsive to outputs from stages of both said left and right serial delay means, said multiplier outputs forming said comparator means output channels; whereby the multiplier or an adjacent pair of multipliers having a maximum output signal indicates a correlation between input left and right attack signals at the respective stage or stages of said serial delay means.

4. Apparatus as claimed in claim 3, wherein inverting summing means are responsive to all said multipliers, a corresponding adder is connected to the output of each multiplier and the output of said inverting summing means is also connected to an input of each corresponding adder, whereby said maximum output signal is enhanced and the sum of the adder outputs is maintained to be substantially constant.

5. Apparatus as claimed in claim 4, wherein said envelope separator consists of an envelope sensor, an inverter responsive to said envelope sensor and a multiplier responsive to said inverter; said envelope signal being output from said envelope sensor and said waveshape signal being output at a constant level from said multiplier.

6. Apparatus as claimed in claim 5 wherein power amplifiers and loudspeakers are connected to each of said additional multipler means to output left and right channel stereo sounds and peak amplifier means are provided for the channels of said sound radiator array.

7. Apparatus as claimed in claim 1 and further comprising, for each channel, a frequency divider responsive to a respective one of said audio input signals, wherein said attack separator means comprises an envelope separator connected in a feedback loop with a multiplier to which is supplied a high frequency output of said frequency divider, an adder being connected to a low frequency output of said frequency divider and to the output of said multiplier to add attackless steady state high frequency signal components to low frequency signal components to produce a combined steady state signal for each channel.

8. Apparatus as claimed in claim 7 wherein power amplifiers and loudspeakers are connected to each of said adders to output left and right channel stereo sounds and peak amplifier means are provided for the channels of said sound radiator array.

* * * * *